US006862002B2

(12) United States Patent
Demicco et al.

(10) Patent No.: US 6,862,002 B2
(45) Date of Patent: Mar. 1, 2005

(54) ANTENNA GROUND PLANE AND WIRELESS COMMUNICATION DEVICE WITH ANTENNA GROUND PLANE AND ACOUSTIC RESISTOR

(75) Inventors: Adam M. Demicco, Davie, FL (US); Kelechi Agada, Plantation, FL (US); Eric S. Penrod, Sunrise, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/447,049

(22) Filed: May 28, 2003

(65) Prior Publication Data

US 2004/0246184 A1 Dec. 9, 2004

(51) Int. Cl.[7] ..... H01Q 1/48
(52) U.S. Cl. ..... 343/846; 343/702
(58) Field of Search ..... 343/702, 846, 343/848, 872, 700 MS

(56) References Cited

U.S. PATENT DOCUMENTS

| | | | | |
|---|---|---|---|---|
| 4,975,713 A | * | 12/1990 | Sheriff | 343/795 |
| 6,259,418 B1 | * | 7/2001 | Jones et al. | 343/846 |
| 6,480,170 B1 | * | 11/2002 | Langley et al. | 343/826 |
| 2002/0080593 A1 | * | 6/2002 | Tsuge et al. | 361/818 |

* cited by examiner

*Primary Examiner*—Hoang V. Nguyen

(57) ABSTRACT

In a wireless communication device 100, a preferably mesh, metal ground plane 314 serves both as an antenna ground plane or as an acoustic resistor for conditioning sound that passes through a sound port 120, 122. The metal ground plane 314 is located between a sound transducer 312 and a sound port 120, 122, but the metal ground plane 314 does not block sound due to openings in the mesh of the ground plane 314. The ground plane 314 permits an ear member 112 to be made thinner and reduces the number of parts required to manufacture the wireless communication device 100.

19 Claims, 3 Drawing Sheets

ANTENNA GROUND PLANE AND WIRELESS COMMUNICATION DEVICE WITH ANTENNA GROUND PLANE AND ACOUSTIC RESISTOR

FIELD OF THE INVENTION

This invention relates in general to wireless communication devices, and more specifically to antenna ground planes for wireless communication devices.

BACKGROUND OF THE INVENTION

Aesthetics and the ceaseless demand for miniaturization in electronics have presented great challenges for designers of electronic products. For example, due to miniaturization and aesthetics, the number of places where an antenna and its related parts can be located in a wireless communications device, such as a portable handset is becoming smaller.

In the current wireless communication environment, wireless communication devices such as cellular handsets require the ability to use multiple frequency bands, for example, to access different services. Operators of such devices, such as international travelers, may need to use the devices in regions where the local communications frequencies differ, so there is a need for a device that can accommodate different transmit and receive frequencies, which may require two antennas. In addition, recent regulations require cellular handsets to support location information for emergencies. Thus, a GPS (Global Positioning System) antenna may be required. Therefore, cellular handsets may require two or more antennas, for example, one for voice communication and one for GPS signals.

Since an additional antenna requires more space, the need for an additional antenna counters the goals of miniaturization and aesthetics. Also, metal is often used to form the housing of cellular handsets for durability and aesthetics. However, metal parts on the housing act as shields and limit the number of places where antennas can be located.

Each antenna requires a ground plane, and good antenna performance requires a large ground plane. Cellular handsets normally include a speaker or earpiece and an opening is required in the handset to permit sound to travel between the speaker and a speaker port formed in the housing. All of these factors limit the location for an antenna and requisite ground plane in typical cellular handsets.

BRIEF DESCRIPTION OF THE DRAWINGS

The accompanying figures where like reference numerals refer to identical or functionally similar elements throughout the separate views and which together with the detailed description below are incorporated in and form part of the specification, serve to further illustrate various embodiments and to explain various principles and advantages all in accordance with the present invention.

DETAILED DESCRIPTION OF PREFERRED EMBODIMENTS

Figure 1:
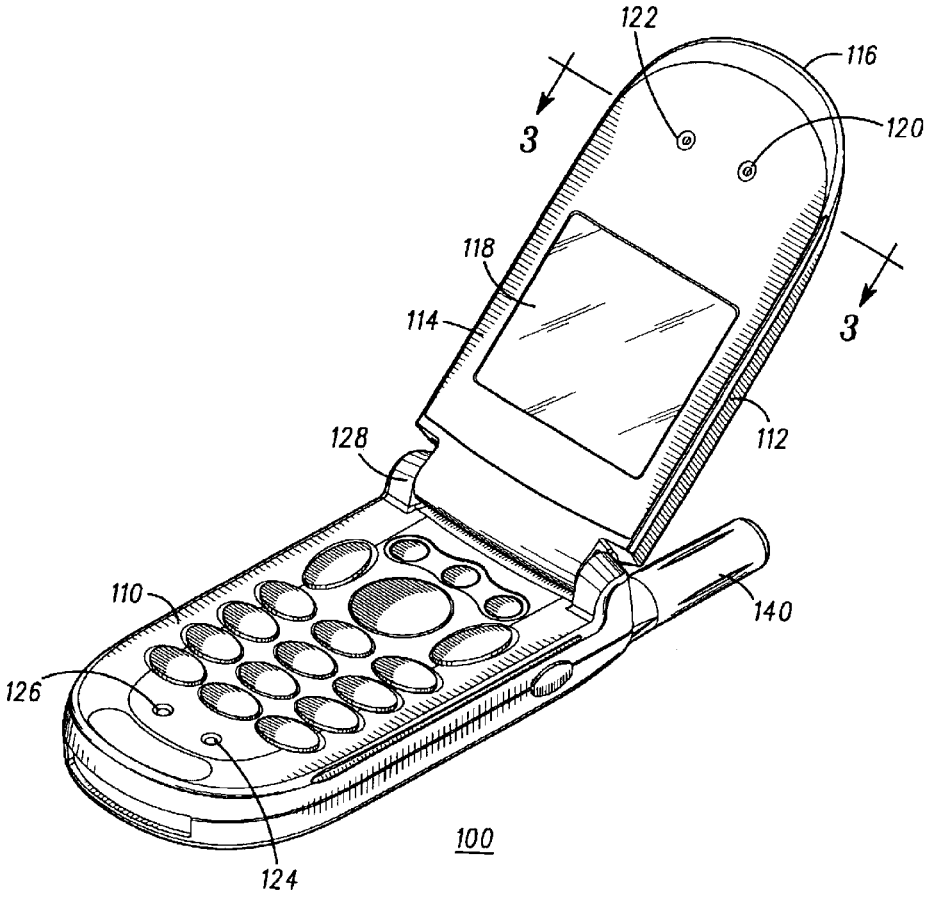
FIG. 1 is a perspective diagram illustrating a wireless communication device according to the invention.

The present disclosure concerns communications systems that provide services such as voice and data communications services to communications devices or units, often referred to as subscriber devices, such as cellular phones, two-way radios, personal digital assistants and the like.

More particularly various inventive concepts and principles embodied in communication devices and methods therein for providing an antenna ground plane and an acoustic resistor are discussed. The communication device can be any of a variety of wireless communication devices, such as a cellular handset or equivalents thereof.

The communication devices that are of particular interest are those that provide or facilitate voice communication services or data or messaging services, such as conventional two way systems and devices, various cellular phone systems including analog and digital cellular, CDMA (code division multiple access) and variants thereof, GSM (Global System for Mobile Communication), GPRS (General Packet Radio System), 2.5 G and 3G systems such as UMTS (Universal Mobile Telecommunication Service) systems, integrated digital enhanced networks and variants or evolutions thereof. Similarly, the communication systems and devices can include LAN (local area network) systems that employ anyone of a number of networking protocols, such as TCP/IP (Transmission Control Protocol/Internet Protocol), AppleTalk™, IPX/SPX (Inter-Packet Exchange/Sequential Packet Exchange), Net BIOS (Network Basic Input Output System) or any other packet structures. Further, communication devices of interest are those that include AGPS As further discussed below various inventive principles and combinations thereof are advantageously employed to provide a wireless communication device, an antenna apparatus, a method for providing a wireless communication with an acoustic resistor and a ground plane, and a method of altering the sound characteristics of a speaker for a wireless communication device, thus alleviating various problems associated with known antennas and wireless devices provided these principles or equivalents thereof are employed.

The instant disclosure is provided to further explain in an enabling fashion the best modes of making and using various embodiments in accordance with the present invention. The disclosure is further offered to enhance an understanding and appreciation for the inventive principles and advantages thereof, rather than to limit in any manner the invention. The invention is defined solely by the appended claims including any amendments made during the pendency of this application and all equivalents of those claims as issued.

It is further understood that the use of relational terms, if any, such as first and second, top and bottom, upper and lower and the like are used solely to distinguish one from another entity or action without necessarily requiring or implying any actual such relationship or order between such entities or actions.

The terms "a" or "an" as used herein are defined as one or more than one. The term "plurality" as used herein is defined as two or more than two. The term "another" as used herein is defined as at least a second or more. The terms "including," "having" and "has" as used herein are defined as comprising (i.e., open language). The term "coupled" as used herein is defined as connected, although not necessarily directly and not necessarily mechanically.

Much of the inventive functionality and many of the inventive principles are best implemented with or in mechanical structures formed in various manners from various materials, such as plastics and metals. It is expected that one of ordinary skill, notwithstanding possibly significant effort and many design choices motivated by, for example, available time, current technology, and economic considerations, when guided by the concepts and principles disclosed herein will be readily capable of generating such mechanical structures with minimal experimentation. Therefore, in the interest of brevity and minimization of any risk of obscuring the principles and concepts according to the present invention, further discussion of such structures, if any, will be limited to the essentials with respect to the principles and concepts used by the preferred embodiments.

Figure 2:
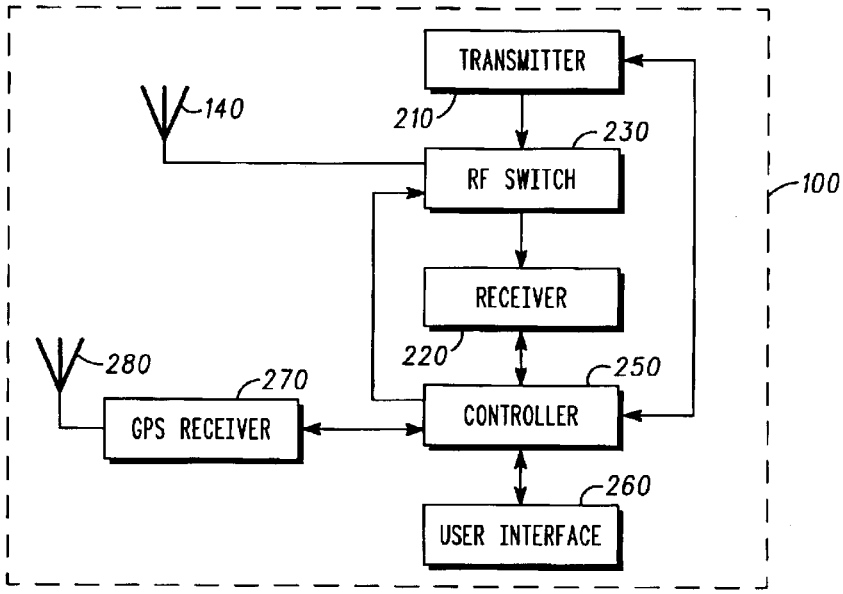
FIG. 2 is a block diagram illustrating selected electronic parts of the wireless communication device of FIG. 1.
Figure 3:
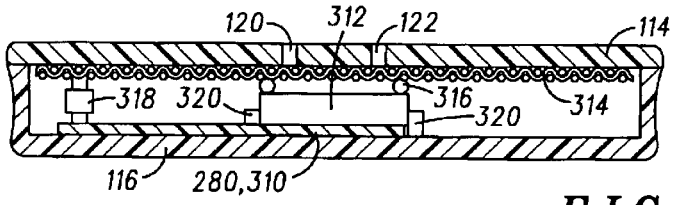
FIG. 3 is a cross sectional diagram as viewed in the direction indicated by line 3—3 in FIG. 1.

Basically, as best shown in FIG. 3, the present disclosure concerns a communication device 100 (see FIGS. 1 and 2) that includes a housing, an active antenna element 280 located in the housing for receiving or transmitting electromagnetic energy, and a metal ground plane 314, which is coupled to the active antenna element 280. The ground plane 314 is made of metal mesh. Incidentally, the figures are not to scale and are diagrammatic in nature, and some dimensions in the figures are exaggerated for illustrative purposes.

The communication device 100 is a portable, clamshell type unit, for example, and the unit includes an ear member 112 or cover, a base 110, and a hinge 128 connecting the ear member 112 to the base 110. A sound transducer 312 is located in the ear member 112. The sound transducer 312 has a front side that faces a user during normal use. The sound transducer 312 of the preferred and illustrated embodiment is a speaker or earpiece; however, in another embodiment, the transducer 312 may be a microphone located in a mouthpiece portion of a handset. A retainer 320 fixes the transducer 312 to a rear housing member 116.

As shown in FIGS. 1 and 3, the housing includes a front housing member 114 and the rear housing member 116. The front housing member 114 includes a transparent lens 118. At least one sound port 120, 122 is formed in the front housing member 114 to permit sound to pass through the front housing member 114. In a conventional manner, additional ports (not shown) that communicate with a rear side of a diaphragm (not shown) of the transducer are formed in the housing to permit the diaphragm to move freely. The sound port 120, 122 is simply an opening formed in the front housing member 114. The sound transducer 312 is located within the housing. The ground plane 314 is located between the sound port 120, 122 and the sound transducer 312.

In the preferred and illustrated embodiment, the wireless communication device 100 includes a primary antenna 140, and the active antenna element 280 referred to previously is a secondary, or supplemental, antenna. The supplemental antenna 280 is preferably a PIF (planar inverted F) antenna and is generally parallel to and in close proximity to the metal ground plane 314. The wireless communication device 100 includes a GPS receiver 270, and the supplemental antenna 280 is thus preferably a GPS antenna for receiving electromagnetic energy. However, an alternative embodiment according to the invention includes a wireless communication device having only one antenna for receiving or transmitting electromagnetic energy. That is, in another, unillustrated embodiment, the active antenna element 280 may be the sole antenna in the wireless communication device 100, and the active antenna element may be used for voice or data and need not be for GPS use.

The metal ground plane 314 is located between the sound transducer 312 and the sound port 120, 122, and the metal ground plane 314 allows sound to pass between the sound port 120, 122 and the transducer 312. That is, the metal ground plane 314 includes a plurality of openings at least in the vicinity of the sound transducer 312 to facilitate the passage of sound, sound waves, or sound pressure waves through the metal ground plane 314 between the sound port 120, 122 and the transducer 312. In the preferred embodiment, the metal ground plane 314 is made entirely of metal wire mesh, and the openings that permit sound to pass are regular spaces between wires of the metal wire mesh.

The metal ground plane 314 should be as thin as possible to reduce the thickness of the ear member 112. The thickness of the metal ground plane 314 may vary, and a satisfactory thickness is, for example, in the range of 0.1–0.5 mm.

Alternatively, the metal ground plane 314 may be made by using a solid metal plate that has the same shape as that of the wire mesh ground plane 314. In this case, small holes are formed in the vicinity of the transducer 312 to permit sound to pass through the plate.

The mesh size, or screen size, of the metal ground plane 314 may vary within limits. If the openings are too large, the mesh will not properly function as an antenna ground plane. If the openings in the mesh are too small, the mesh will block sound. In general, the mesh size must be determined experimentally and is chosen for sound quality under the specific conditions that apply. For example, the particular transducer and housing being used will affect the sound and may affect the choice of mesh size. In a prototype device, a metal ground plane 314 having a mesh size of 180 wires per inch in both the vertical and horizontal directions was employed with satisfactory results.

The material of the metal ground plane 314 is preferably stainless steel. Other materials such as copper may also be used. However, for example, a copper ground plane must be coated to protect it from corrosion. If a copper ground plane were coated with plastic to protect it from corrosion, it would be significantly thicker than an uncoated ground plane and would increase the thickness of the ear member 112, which counters the goal of making the ear member 112 thinner.

Figure 5:
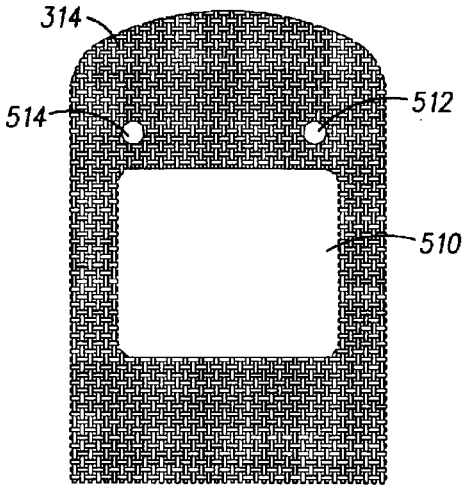
FIG. 5 is a plan view of the mesh, metal ground plane of FIG. 3.

Other than the small, regular openings between the wires of the mesh, other various openings are formed in the metal ground plane 314 as shown in FIG. 5. A pair of upper openings 512, 514 permits fasteners, such as screws, to pass thorough the metal ground plane 314. A lens opening 510 permits a display 430 to be viewed through the metal ground plane 314 and through the transparent lens 118. As shown in FIG. 5, in the illustrated embodiment, the overall shape of the metal ground plane 314 generally conforms to the shape of the ear member 112 or portion thereof. However, other shapes can be used to achieve equivalent results.

The metal ground plane 314 can also serve as an acoustic resistor to alter characteristics of the sound passing through the metal ground plane 314. Typically, in wireless handsets, a piece of felt material, or acoustic felt, is placed between a sound port and a sound transducer to serve as an acoustic resistor. However, in the illustrated embodiment, the metal ground plane 314 serves as an acoustic resistor, rendering felt material unnecessary. As shown in FIG. 3, a rubber O-ring 316, or seal, is fitted between the transducer 312 and the metal ground plane 314 to form a seal around the sound port 120, 122. A space of approximately 0.1–0.2 mm exists between the transducer 312 and the ground plane 314, in which the O-ring 316 is located.

Figure 6:
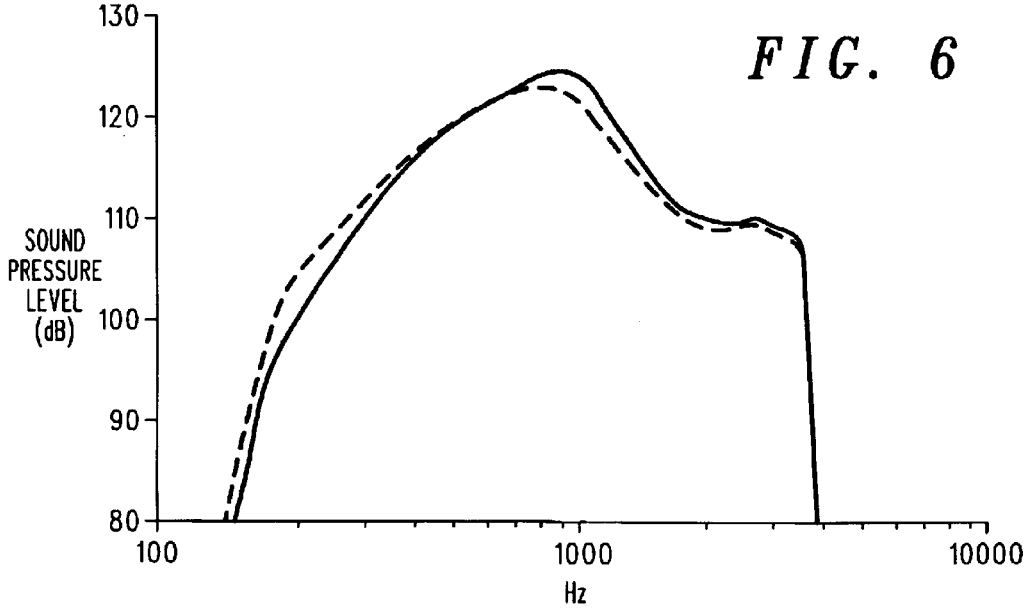
FIG. 6 is a graph showing sound pressure level according to frequency with the metal ground plane in place and without the metal ground plane.

FIG. 6 shows a graph of sound pressure level versus frequency. The solid line shows the sound pressure level as measured without metal mesh between the sound port 120, 122 and the transducer 312 in a prototype. The broken line shows the same measurement when the metal ground plane 314 is located between the transducer 312 and the sound port 120, 122. The graph shows that the metal ground plane 314, serving as an acoustic resistor, reduces the maximum sound pressure level in midrange frequencies and raises the sound pressure level at lower frequencies, which is approximately the same effect that felt material has when placed between a transducer and a sound port of a wireless handset. Therefore, the metal ground plane 314 of the present invention serves as both an antenna ground plane and an acoustic resistor, which reduces the number of parts required to manufacture the device 100 and permits the ear member 112 to be thinner.

The wireless communication device 100 includes a flexible circuit 310, or laminated circuit. The flexible circuit 310 is located in the housing and is spaced from the metal ground plane 314, as shown in FIG. 3. The flexible circuit 310 is a plastic and metal laminate, which is well known in the art. The supplemental antenna 280, or the active antenna element, is preferably made of copper and is formed on the flexible circuit 310 by conventional methods, such as etching a copper layer formed on a substrate. The length and shape of the supplemental antenna 280 are chosen for tuning the appropriate frequency band in a manner will known in the art. In the illustrated embodiment, the supplemental antenna 280 is tuned to receive GPS signals. The flexible circuit 310 is placed such that the supplemental antenna 280 is generally parallel to the ground plane 314, as shown. In the preferred embodiment, a driver circuit for driving the display and other circuitry are also formed on the flexible circuit 310. The flexible circuit 310 includes a plastic coating to prevent corrosion of metal parts in a known manner.

A pin connector 318 couples the supplemental antenna 280 to the ground plane 314, as shown in FIG. 3. The pin connector 318 includes opposed, spring-loaded pins that are electrically connected to one another. One or more pairs of pins may be formed on the pin connector 318. In the illustrated embodiment, a pin on one side of the pin connector 318 makes direct contact with the ground plane 314, and an opposite pin makes contact with the supplemental antenna 280 or metal coupled to the supplemental antenna 280, when the front housing member 114 is joined to the rear housing member 116. The plastic coating on the flexible circuit 310 includes at least one opening to permit at least one pin of the pin connector 318 to make direct contact with the supplemental antenna 280 or metal coupled to the supplemental antenna 280. The pins of the pin connector 318 are preferably gold plated to prevent corrosion. Other types of connectors may be used for coupling the ground plane 314 to the supplemental antenna 280 with equivalent results.

FIG. 2 is a block diagram showing components of the wireless communication device 100. A transmitter 210 and a receiver 220 are coupled to the primary antenna 140 through an RF switch 230 in a known manner. The RF switch 230 and the transmitter 210 are coupled to a controller 250, which is also coupled to a user interface 260. The GPS receiver 270 is further coupled to the controller 250. The active antenna element, or supplemental antenna, 280 is coupled to the GPS receiver 270 for receiving electromagnetic GPS signals in a known manner.

Figure 4:
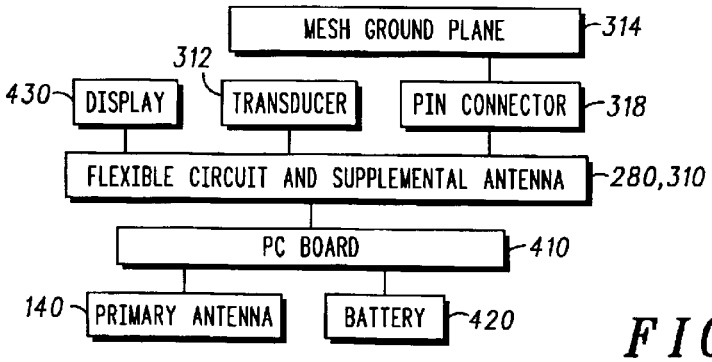
FIG. 4 is a block diagram illustrating the interconnection of various parts of the wireless communication device of FIG. 1.

FIG. 4 is a block diagram showing relationships between parts of the wireless communication device 100. A battery 420 powers the device 100 and is connected to a PC board 410. On the PC board 410 is circuitry for, among other things, the transmitter 210 and the receiver 220. As shown, the flexible circuit 310 is coupled to the PC board 410, and the display 430 and the transducer 312 are coupled to the flexible circuit 310. FIG. 4 also shows the coupling of the ground plane 314 and the supplemental antenna 280 by the pin connector 318, which was described previously.

The apparatus and methods discussed above and the inventive principles thereof are intended to and will alleviate problems caused by prior antennas and wireless communication devices. Using these principles of ground plane design will facilitate compliance with regulations and will contribute to user satisfaction. It is expected that one of ordinary skill given the above described principles, concepts and examples will be able to implement other alternative procedures and constructions that offer the same benefits. It is anticipated that the claims below cover many such other examples. For example, the fastener holes 512, 514 may be omitted or relocated to create a larger uninterrupted ground plane area. Further, the mesh of the ground plane may cover the display 430, if a transparent or partially transparent mesh is employed. In other words, the lens opening 510 may be omitted. Also, the metal mesh ground plane may be positioned in the base 110 between a microphone port 124, 126 and a microphone (not shown). In this case, the ground plane would be coupled to an antenna located in the base 110. Although the illustrations show a clamshell type of communication unit, the invention is equally applicable to a monolith type of communications unit. Also, although the illustrations show the ground plane covering a relatively low output level audio transducer or earpiece, that is designed to be placed close to the ear, the ground plane 314 may also cover a higher output audio transducer that is designed to be spaced apart from the user during use, so that the communication unit can serve as a speaker phone.

The disclosure is intended to explain how to fashion and use various embodiments in accordance with the invention rather than to limit the true, intended and fair scope and spirit thereof. The forgoing description is not intended to be exhaustive or to limit the invention to the precise form disclosed. Modifications or variations are possible in light of the above teachings. The embodiments were chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled.

What is claimed is:

1. A communication device comprising:

a housing including a sound port, and a sound transducer that is located within the housing;

an active antenna element located in the housing for receiving or transmitting electromagnetic energy; and a metal ground plane, which is coupled to the active antenna element, wherein the metal ground plane is made of metal mesh and is located between the sound port and the sound transducer.

2. A communication device according to claim 1, wherein the communication device is a potable, clamshell type unit, and the unit includes an ear member, a base, and a hinge connecting the ear member to the base, and wherein the sound transducer is located in the ear member.

3. A communication device according to claim 1, wherein the active antenna element is a planar antenna and is generally parallel to the metal ground plane.

4. A communication device according to claim 1, wherein the device includes a GPS receiver and the active antenna element is a GPS antenna.

5. A communication device comprising:

a housing, wherein the housing includes a sound port to facilitate the passage of sound;

a sound transducer located within the housing, wherein the sound transducer has a front side that faces a user during normal use;

an active antenna element for receiving or transmitting electromagnetic energy; and a metal ground plane, which is coupled to the active antenna element, wherein a part of the metal ground plane is located between the sound transducer and the sound port, and the metal ground plane allows sound to pass between the sound port and the sound traducer.

6. A communication device according to claim 5, wherein the metal ground plane includes a plurality of openings at least in a vicinity of the sound transducer to facilitate the passage of sound through the metal ground plane between the sound port and the sound transducer.

7. A communication device according to claim 6, wherein the metal ground plane includes a metal wire mesh, and the plurality of openings are a plurality of spaces between wires of the metal wire mash.

8. A communication device according to claim 6, wherein the metal ground plane is formed by a generally planar sheet of metal wire mesh, and the plurality of openings are a plurality of spaces between wires of the metal wire mesh.

9. A communication device according to claim 5, wherein the metal ground plane serves as an acoustic resistor to alter characteristics of the passage of sound through the metal ground plane.

10. A communication device according to claim 5, wherein the communication device includes a laminated circuit and the laminated circuit is located in the housing and spaced from the metal ground plane, and the active antenna element is formed on the laminated circuit.

11. A communication device according to claim 10, wherein the laminated circuit is a plastic and metal laminate.

12. A communication device according to claim 5, wherein a seal is located between the sound transducer and the metal ground plane.

13. A communication device according to claim 5, wherein the sound transducer is a speaker.

14. A communication device according to claim 5, wherein the active antenna element is a planar antenna and is generally parallel to the metal ground plane.

15. A communication device according to claim 5, wherein the communication device is a portable, clamshell type unit and the unit includes an ear member, a base, and a hinge connecting the ear member to the base, and wherein the sound transducer is located in the ear member.

16. A communication device according to claim 5, wherein the communication device includes a GPS receiver and the active antenna element is a GPS antenna.

17. A metal ground plane for operating in conjunction with an antenna portable communication device, wherein the metal ground plane is made of metal mesh and configured to be placed between a sound transducer and a sound port.

18. A metal ground plane according to claim 17, wherein the metal ground plane is a generally planar sheet made of stainless steel wire.

19. A metal ground plane according to claim 18, wherein an opening is formed in the generally planar sheet to permit viewing of a display through the metal ground plane.

* * * * *